US007080606B1

(12) United States Patent
Harrison

(10) Patent No.: US 7,080,606 B1
(45) Date of Patent: Jul. 25, 2006

(54) MOORING LINE DEVICE

(76) Inventor: Robert W. Harrison, 5844 Los Molinos Dr., Buena Park, CA (US) 90620

( * ) Notice: Subject to any disclaimer, the term of this patent is extended or adjusted under 35 U.S.C. 154(b) by 0 days.

(21) Appl. No.: 11/201,944

(22) Filed: Aug. 9, 2005

(51) Int. Cl.
*B63B 21/00* (2006.01)

(52) U.S. Cl. ..... 114/230.2; 242/404

(58) Field of Classification Search ..... 114/230.2, 114/230.21–230.29; 242/404
See application file for complete search history.

(56) References Cited

U.S. PATENT DOCUMENTS 3,977,448 A * 8/1976 Botting ..... 114/210
4,713,033 A * 12/1987 Cameron ..... 441/84
4,846,090 A * 7/1989 Palmquist ..... 114/230.23
4,875,427 A 10/1989 Harris, Jr.
5,540,178 A * 7/1996 Damron ..... 114/362
5,715,769 A 2/1998 Mills
6,041,729 A 3/2000 Alan
6,880,702 B1 * 4/2005 Colorado ..... 206/388

* cited by examiner

*Primary Examiner*—Jesus D. Sotelo
(74) *Attorney, Agent, or Firm*—Dennis W. Beech

(57) ABSTRACT

The mooring line device may be used for watercraft mooring to for example a dock. A bag may have a first wall, a second wall, two side walls, a bottom wall and a top wall with the top wall having an aperture. A hook may be disposed in the aperture with an attachment element protruding from the bag. The two side walls and the bottom may have a continuous opening with a closure device. A rope at a proximal end may be attached to the hook. A strap may be attached to one of the first or second walls and may be disposed to retain a rope when the rope is folded for storage in the bag.

15 Claims, 1 Drawing Sheet

MOORING LINE DEVICE

BACKGROUND OF THE INVENTION

This invention relates to devices for watercraft mooring line storage and deployment. The new mooring line device may allow storage of mooring lines on a hitching device of a boat from which storage the mooring lines may be extracted and used to moor the boat at for example a dock.

Mooring lines for watercraft and the storage thereof may be known. Some storage devices may be used that have the appearance of other boat elements such as boat fenders. These may have internal storage chambers for mooring lines or rope. The storage devices may also have a duel use as for example a functional boat fender that may have a rope storage compartment.

SUMMARY OF THE INVENTION

The present invention is directed to devices for watercraft mooring to for example a dock. A bag may have a first wall, a second wall, two side walls, a bottom wall and a top wall with the top wall having an aperture. A hook may be disposed in the aperture with an attachment element protruding from the bag. The two side walls and the bottom may have a continuous opening with a closure device. A rope at a proximal end may be attached to the hook. A strap may be attached to one of the first or second walls and may be disposed to retain a rope when the rope is folded for storage in the bag.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
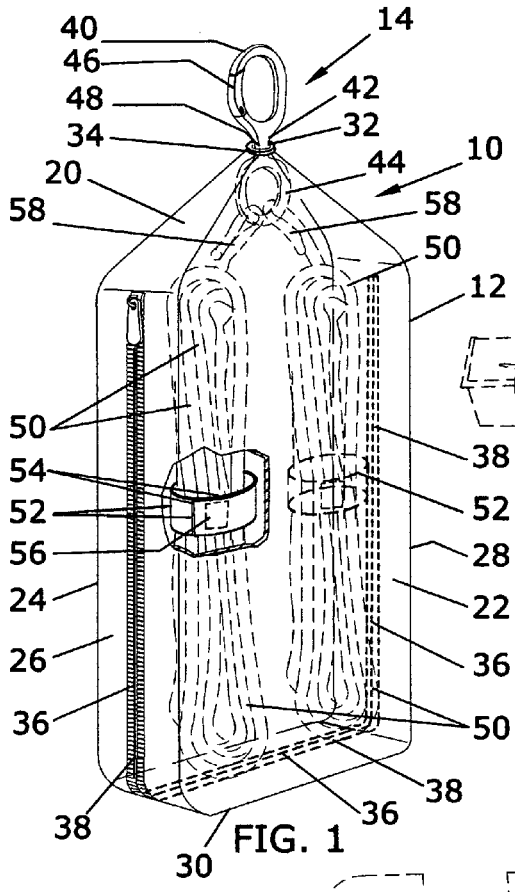
FIG. 1 illustrates a perspective elevation partial section view of the mooring line device according to an embodiment of the invention.

Referring to FIG. 1, a mooring line device 10 may have a container or bag 12 and a hook 14. The hook 14 may be partially disposed in the bag 12 at a top 20 to allow an attachment element 40 to protrude from the top 20. The attachment element 40 may be attached to a watercraft hitching device, such as, a cleat, a ring or the like, to suspend the mooring line device 10 therefrom. The attachment element 40 may be joined by a neck 42 to a ring 44.

The container or bag 12 may be generally rectangular in shape having a first wall 22, second wall 24, two side walls 26, 28, a bottom wall 30 and a top 20. The top 20 may be elongated to form a generally pyramid shape or it may simply be a generally flat top wall form. There may be an aperture 32 in the top 20 that may be in the apex 34 of the pyramid form. The neck 42 of the hook 14 may be disposed in the aperture 32 with the ring 44 positioned interior to the bag 12 and the attachment element 40 positioned exterior to the bag 12. There may be a blocking element, such as, a washer, a rope loop 48 or the like disposed on neck 42 interior to bag 12 to inhibit pulling of the hook 14 through the aperture 32.

There may be a closable opening 36 formed in the two side walls 26, 28 and the bottom wall 30. The opening 36 may be in the form of a slit that may be formed longitudinally and continuously the length of each side wall 26, 28 and the bottom wall 30. The opening 36 may be closed by overlapping hook and loop devices, by snaps, by a zipper 38 or like devices.

One or more ropes 50, lines, mooring lines or the like may be attached at a proximal end 58 to the ring 44. The ropes 50 may be approximately 8 feet in length for a mooring line and may be coiled or folded to be disposed interior to the bag 12. Straps 52 may be attached to one of the walls 22, 24 for use in retaining the ropes 50 interior to the bag 12. the straps 52 may be attached by sewing or other suitable method and may have open ends 54 that may be closed around the folded ropes 50 and secured by a fastener 56 such as hook and loop, snaps and the like.

Figure 3:
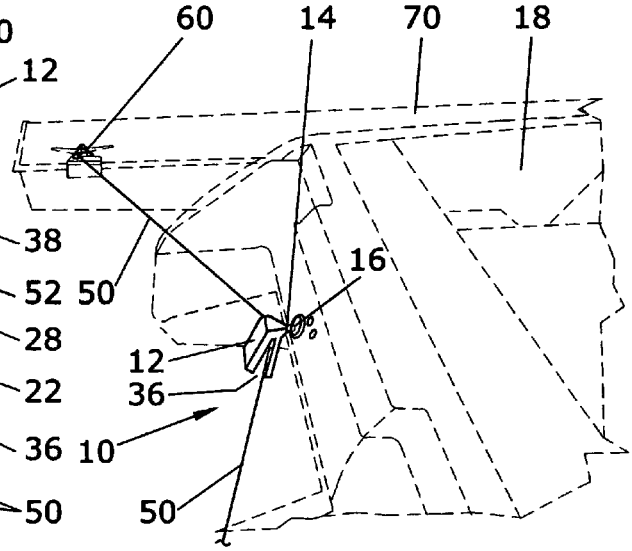
FIG. 3 illustrates a perspective view of the deployed mooring line device according to an embodiment of the invention.
Figure 2:
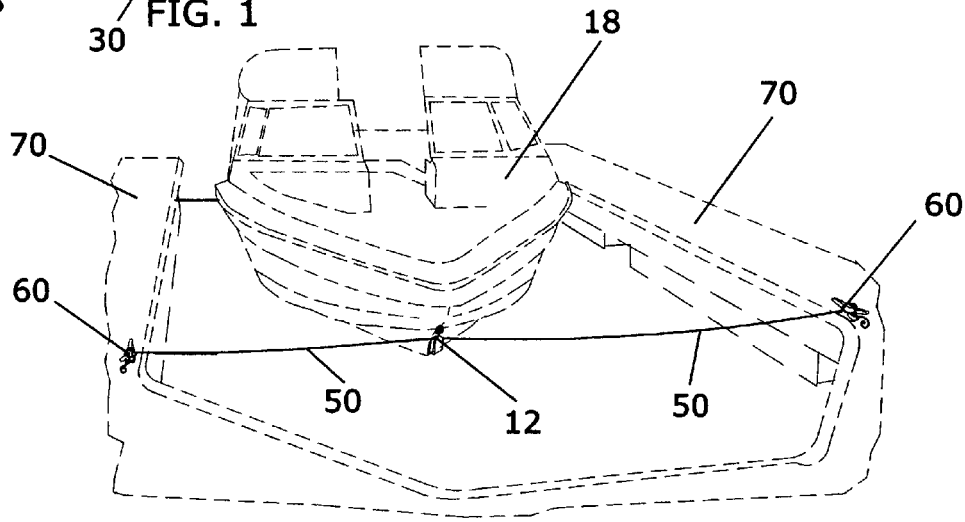
FIG. 2 illustrates a perspective view of the deployed mooring line device according to an embodiment of the invention.

Referring to FIGS. 1 through 3, in use the mooring line device 10 may be attached to a watercraft hitching device 16. The attachment element 40 of the hook 14 may have a closure element 46 that may be pushed open when pressed against an object such as a cleat, ring, rail or the like and may be spring biased to close once the attachment element engages the hitching device 16. The zipper 38 may be unzipped and the straps 52 opened to allow removal of the ropes 50 from the bag 12. The distal end 60 of the ropes 50 may then be attached to a dock 70 to moor the watercraft 18. When it may be desired to use the boat 18, a reverse process may be used to release the boat 18 from the dock 70 mooring and to store the ropes 50 in the bag 12 to be available for the next use. The bag 12 may be formed in the general shape of a boat wherein the top 20 pyramid form may approximate the shape of a bow of a boat.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for watercraft mooring comprising:

a bag having a first wall, a second wall, two side walls, a bottom wall and a top wall and said top wall having an aperture formed therein;

a hook disposed in said aperture with an attachment element protruding from said bag;

said two side walls and said bottom wall having a continuous opening with a closure device;

a rope at a proximal end attached to said hook; and a strap attached to one of said first wall and said second wall and disposed to retain said rope when said rope is folded for storage in said bag.

2. The device as in claim 1 wherein said hook having a ring attached to a neck that is attached to said attachment element; said neck is disposed in said aperture; and said proximal end of said rope is attached to said ring.

3. The device as in claim 2 wherein a blocking element is disposed on said neck interior to said bag.

4. The device as in claim 1 wherein said attachment element having an attachment closure device spring biased in a closed position.

5. The device as in claim 1 wherein said top wall is formed in a pyramid shape and said hook is disposed in said aperture positioned in an apex of said top wall.

6. The device as in claim 1 wherein said bag is formed in an approximate shape of a boat.

7. The device as in claim 1 wherein said strap having two ends with a fastener element at each end.

8. The device as in claim 7 wherein said fastener element is a hook and loop device.

9. The device as in claim 1 wherein said closure device is a zipper.

10. The device as in claim 9 wherein said zipper is a nylon material.

11. A device for watercraft mooring comprising:

a bag having a first wall, a second wall, two side walls, a bottom wall and a top wall formed in a pyramid shape with an apex having an aperture therein;

a hook having an attachment element attached to a neck that is attached to a ring and said hook disposed with said neck in said aperture, said attachment element exterior to said bag and said ring interior to said bag;

said two side walls and said bottom wall having a continuous opening with a closure device;

two ropes attached to said ring at a proximal end of each rope; and two straps attached to one of said first wall and said second wall wherein each of said straps having two ends with a fastener element at each of said two ends, and each of said straps disposed to retain one of said two ropes when each of said two ropes are folded for storage in said bag.

12. The device as in claim 11 wherein said attachment element having an attachment closure device spring biased in a closed position.

13. The device as in claim 11 wherein said fastener element is a hook and loop device.

14. The device as in claim 11 wherein said closure device is a zipper.

15. The device as in claim 11 wherein said closure device is a hook and loop device.

* * * * *